United States Patent [19]

Garrido Vasquez

[11] Patent Number: 5,058,223

[45] Date of Patent: Oct. 22, 1991

[54] SPRING MATTRESS STRIP

[75] Inventor: Vicente G. Vasquez, Madrid, Spain Spain

[73] Assignee: Comercial Distribuidora De Medios Audiovisuales, S.A., San Fernando De Hernares, Spain

[21] Appl. No.: 368,101

[22] Filed: Jun. 19, 1989

Related U.S. Application Data

[63] Continuation of Ser. No. 112,074, Oct. 26, 1987, abandoned.

[30] Foreign Application Priority Data

Oct. 29, 1986 [ES] Spain ..... 8602819

[51] Int. Cl.[5] ..... A47C 23/06

[52] U.S. Cl. ..... 5/237; 5/241; 267/36.1; 267/158; 108/901

[58] Field of Search ..... 5/191, 236 R, 236 B, 5/237, 239, 241, 245; 267/47, 36.1, 80, 131, 158, 160; 108/901, 902; 297/DIG. 2

[56] References Cited

U.S. PATENT DOCUMENTS

| | | | |
|---|---|---|---|
| 51,755 | 12/1865 | Schott | 5/236 |
| 3,462,195 | 8/1969 | Allen | 297/273 |
| 3,634,894 | 1/1972 | Harbison | 297/DIG. 2 X |
| 3,636,574 | 1/1972 | Kramer | 297/DIG. 2 X |
| 4,476,595 | 10/1984 | Ikeda | 297/DIG. 2 |
| 4,533,179 | 8/1985 | Nichols et al. | 297/DIG. 2 |
| 4,535,494 | 8/1985 | Diamonstein | 5/236 R X |
| 4,704,751 | 11/1987 | Guerra | 5/237 |

*Primary Examiner*—Michael F. Trettel
*Assistant Examiner*—Michael J. Milano
*Attorney, Agent, or Firm*—Staas & Halsey

[57] ABSTRACT

Spring strips for spring mattresses, of the type having an intrinsical convexity, has a one piece construction capable of being manufacturing by a process of moulding, and includes end portions for coupling to a mattress frame by means of a plurality of longitudinal ribs in the manner of beams having longitudinally variable width edges with a maximum at the center line of the spring strip and a minimum near said end portions. The ribs are stiffened by a plurality of longitudinal and transversal diaphragms forming a grating of junctions and bars which constitute the area for the load support. For this purpose, a flexible plastic material is used.

5 Claims, 3 Drawing Sheets

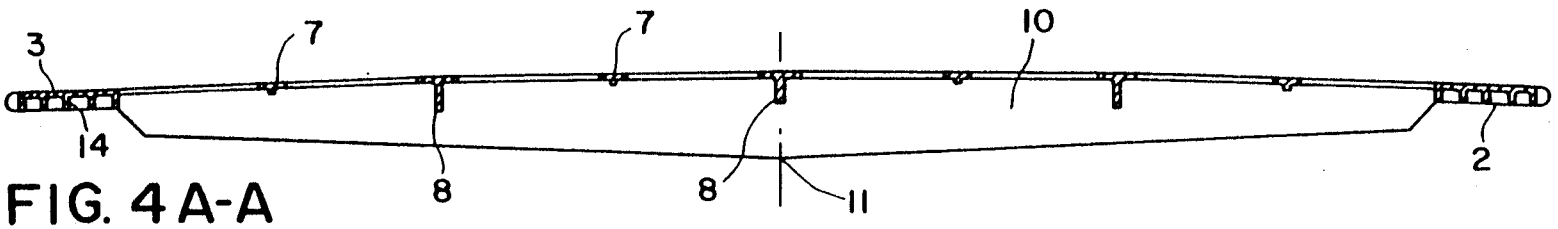
FIG. 4A-A
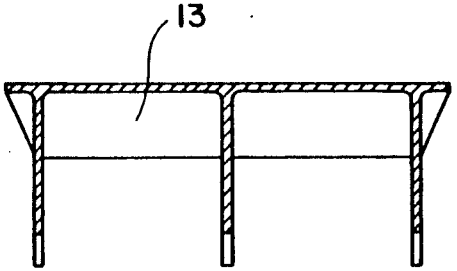
FIG. 7D-D
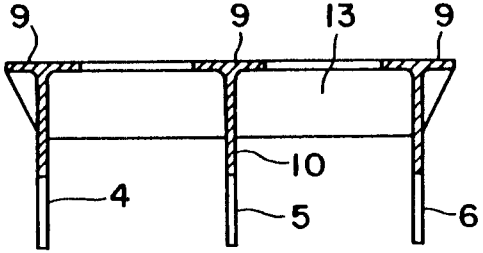
FIG. 6C-C
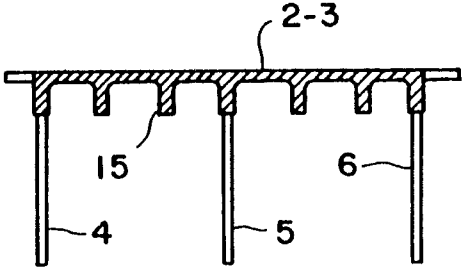
FIG. 5B-B
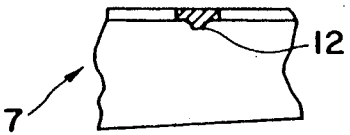
FIG. 10G-G
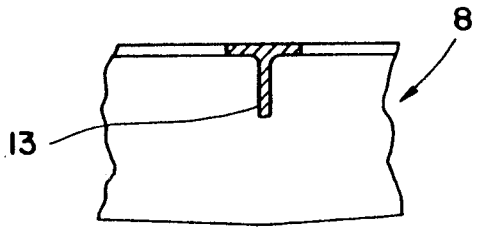
FIG. 9F-F
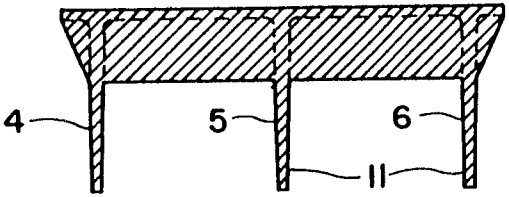
FIG. 8E-E

SPRING MATTRESS STRIP

This is a continuation of co-pending application Ser. No. 07/112,074 filed on Oct. 26, 1987 now abandoned.

BACKGROUND OF THE INVENTION

1. Field of the Invention

This invention relates to spring mattress strips and, more particularly, to a strip structure made of plastic material with a reduced intrinsic weight and a high flexibility, which enables it to support relatively heavy loads without suffering permanent deformations.

2. Description of the Related Art

Spring mattresses made of plastic strips having the objective to provide a support, which under the load of a human body at rest adopts a perfectly horizontal disposition, are already known. It has been scientifically verified that beneficial effects are obtained, by using these strips for the prophylaxis of complaints affecting the spinal column.

On the other hand, the condition of "comfort" of this type of spring mattress is determined by the flexibility of the support, i.e., by the capacity of deformation thereof under light loads. Consequently, the spring strips for this type of mattress should be capable of being deformed elastically and to adopt a disposition, which should be as horizontal as possible under the load conditions of a human body at rest. For this purpose, strips made of flexible material should have a certain convexity in order to absorb the deformations caused by the load.

In addition, the resistance of the strips of this type, which are used to form spring mattresses, should not only be calculated for supporting the load of the human body at rest, but it should also have the necessary dimensions for supporting much heavier loads, for the event of misuse made by the users, and even for high peak loads, without suffering permanent deformations.

Another technical limitation for the material, of which the strips are to be made, is determined by the relatively low weight requirements of a spring mattress, which requires the use of strips as light as possible. In the past, only strips made of wood, either massive or plywood, having a compact structure with a determined convexity, are known. The utilization of wood, either massive or plywood, represents as such a strong limitation to the object proposed for these spring mattresses, because wood is an anisotropic material, wherein the typical problems caused by the accumulation of shearing and carving stresses (weak points) are produced. In addition, this lack of homogeneity causes undesired deformations of "warping", particularly due to the humidity absorption.

SUMMARY OF THE INVENTION

Therefore, an object of the present invention is to develope a structure for spring mattress strips capable of preventing the described problems and inconveniences.

This and other objects are achieved according to the present invention, in which a spring structure includes a plurality of longitudinal "beams" with T-sections, preferably three of them, having the edges thereof progressively increasing dimensionally between the section situated near the support and the center of the opening, the beams being rigidized by means of diaphragms with an edge, and where in addition the proportions or areas of support are constituted by a grating determined by a plurality of longitudinal and transversal diaphragms.

Preferably, the strips are made of plastic material having prescribed elastic limits and a prescribed modulus of elasticity.

In accordance with another aspect of the invention, the grating of transversal and longitudinal diaphragms of the support areas provides an adequate "transpirability", which avoids undesired accumulations of humidity.

According to a preferred embodiment of the invention, the strips are formed of unibody construction capable of being manufactured by thermomoulding or injection, having generally an oblong disposition with end portions for support or coupling to a mattress frame and an area for bearing the load, constituted by a grating of longitudinal and transversal diaphragms, with a total number of 39 junctions and 46 bars.

Other features and advantages of the invention will become clearer by means of the following detailed description in conjunction with the attached drawings which illustrate a preferred embodiment.

BRIEF DESCRIPTION OF THE DRAWINGS

FIGS. 4 to 10 show sectional views taken along lines A—A, B—B, C—C, D—D, E—E, F—F, G—G, respectively, of FIG. 3;

DETAILED DESCRIPTION OF THE PREFERRED EMBODIMENTS

Figure 1:
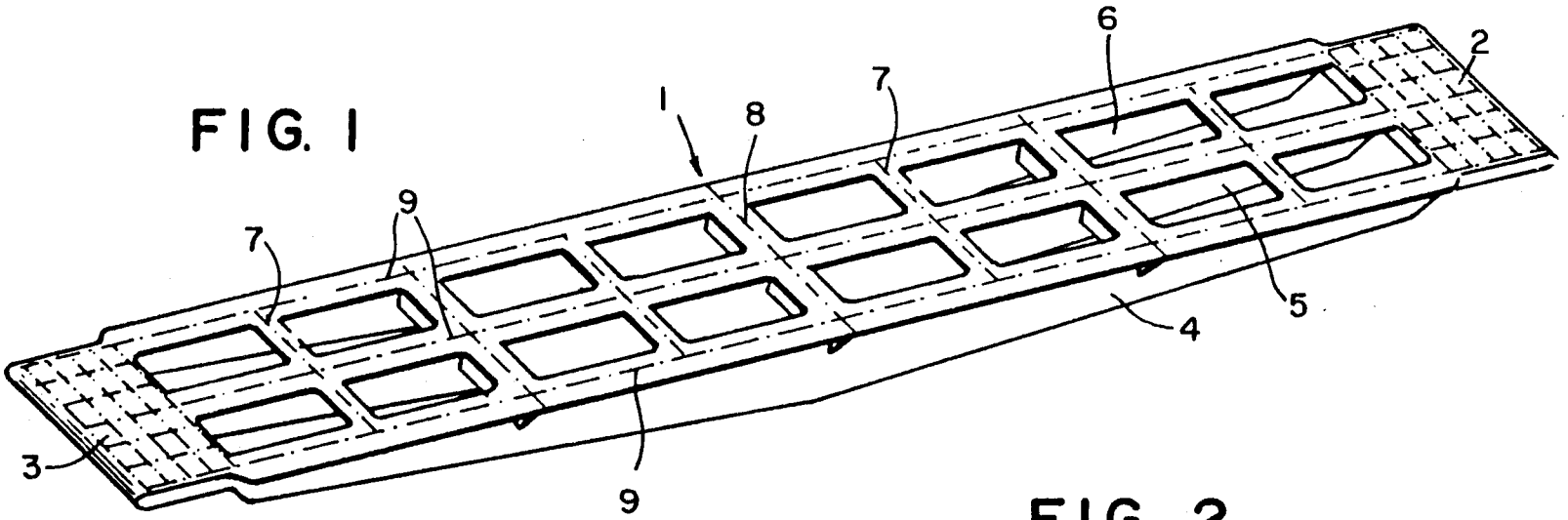
FIGS. 1 to 3 illustrate perspective elevational and plan views, respectively, of a structure for spring mattress strips, realized according to a preferred embodiment of the invention.

With reference to FIGS. 1 to 10, a strip 1 is constituted by a monoblock body, and includes opposite end portions 2 and 3 for coupling and fixing the strip to a mattress frame (not shown), and three longitudinal beam sections 4, 5 and 6, respectively. The end portions 2 and 3 are stiffened by the longitudinal beams 4 to 6 by means of a plurality of transversal diaphragms 7 and 8 and longitudinal diaphragms 9.

Figure 2:
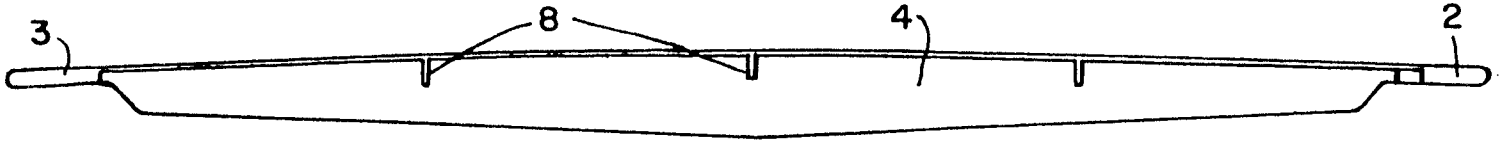
Figure 3:
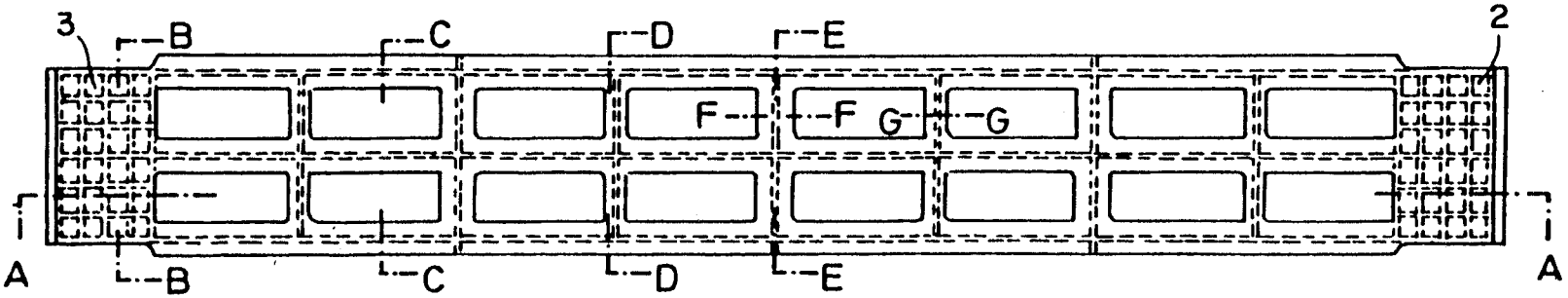

With reference to FIG. 2, it can be seen that strip 1 is shaped with a certain convexity or camber for absorbing the deformations produced by the load, in order to adopt a disposition as horizontal as possible (comfort) for a load corresponding to the standard of the user. The camber will be preferably about 12.07 mm.

Still referring to FIG. 2, each one of the three beams 4 to 6 present an edge 10 longitudinally variable between the end portions 2 and 3 and the center 11, so that by this way the edge increases between the ends and the center of the strip 1. Preferably, the edge 10 will be comprised between 25 mm for the section near the supports and 50 mm in the center 11 of the opening.

With reference to FIGS. 2 and 10, it may be observed that the transversal diaphragms 7 present a transversal section in "T" with a vertical branch 12, which is only slightly signified.

To the contrary, the transversal diaphragms 8, which are broader, as it may be observed in FIGS. 2, 6 and 7, present a transversal section also in "T" with a wide vertical branch 13 and bevelled terminal ends.

Referring now to FIGS. 4 and 5, the end portions 2 and 3 for coupling or support on the mattress frame are provided in the lower part with longitudinal reinforcing ribs 14 and transversal ones 15.

As it may be observed in FIGS. 2, 4 and 5, the "beams" 4 to 6 present edges 10 which decrease progressively between a maximum in the center line 11 of the strip 1 and a minimum for the area of union to the end portions 2 and 3. The edge 10 varies preferably between 50 and 25 mm.

Figure 11:
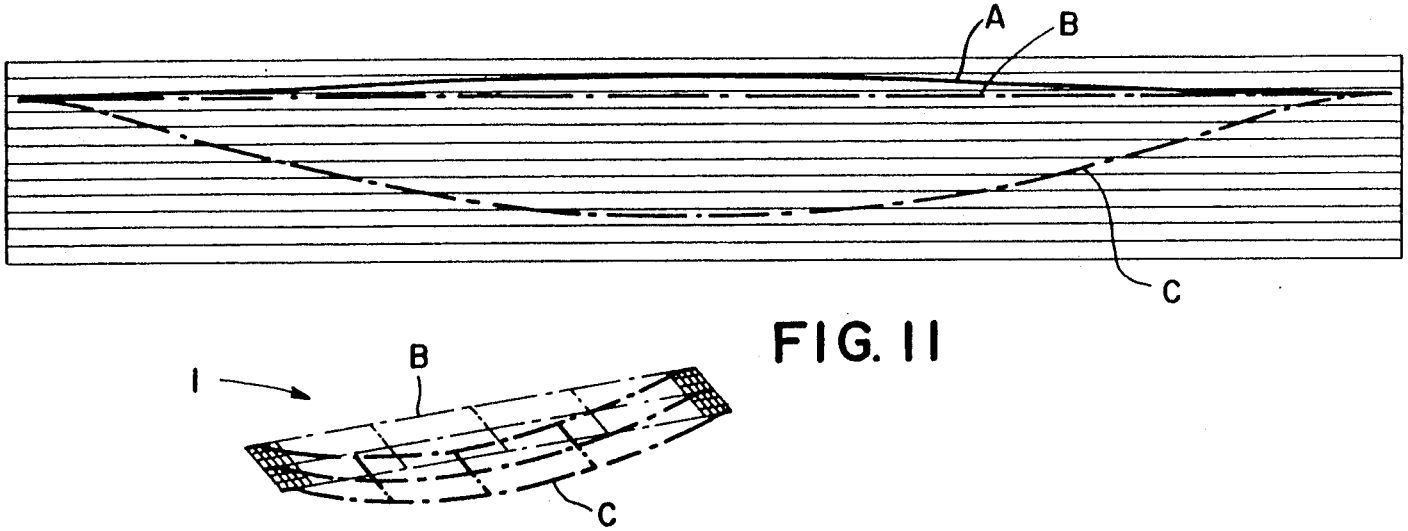
FIG. 11 illustrates deformation diagrams for two load hypothesis, with polypropylene being the material of which the strips are made.
Figure 12:
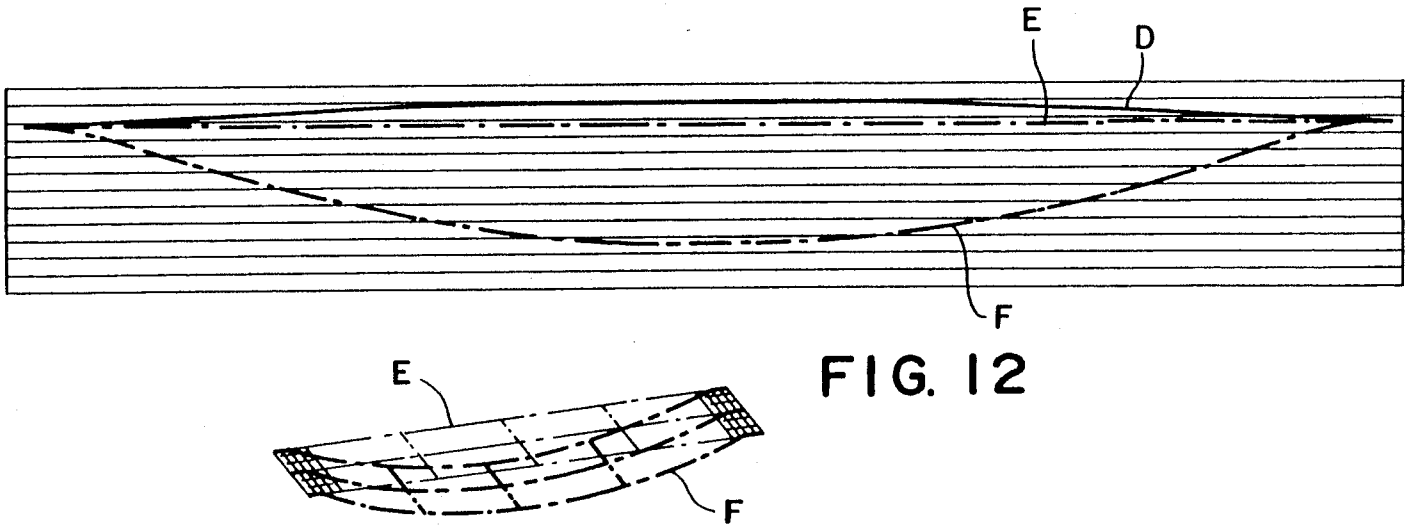
FIG. 12 deformation diagrams for identical load hypothesis, with polyethylene being the material for the strips.

Hereunder and with reference to FIGS. 11 and 12, the behavior of deformation of the strip 1 according to the invention is described, referring to two different load hypothesis and for two plastic materials which are preferred for the manufacturing of said strips.

FIG. 11 shows a deformation diagram of a strip structure made of polypropylene. Therein, curve A illustrates the intrinsical convexity of the structure, i..e, without being exposed to any load, while curves B and C show respectively the deformation behavior for peak loads of horizontality and rupture. In this connection it has to be clarified that as the load of horizontality has to be understood the load, whereunder the structure 1 adopts a perfectly horizontal disposition, and the load of rupture refers to the limit before reaching the plastification of the material constituting the same.

Analogously, FIG. 12 shows by the curves E and F the behavior of horizontality and rupture of structure 1, while curve D illustrates the structure without deformation showing the intrinsical convexity thereof.

In the course of the tests, which have been realized, the values for the load of horizontality and the load of rupture have been fixed on 12.45 Kp and 84.54 Kp, respectively, for a structure made of polypropylene and on 10.63 and 72.46 Kp, respectively, for an identical structure made of polyethylene.

I claim:

1. A spring strip for use in spring mattresses comprising:

a one piece elongated body having an upper surface with an intrinsic camber, opposite end portions for coupling to a support, a lower surface, three longitudinal beam portions extending longitudinally along the lower surface and having edges and being stiffened between each other by a plurality of transverse and longitudinal diaphragms forming a grating of junctions and bars, which are disposed in an area of load support, the edges of the longitudinal beam portions having a width which varies longitudinally between a maximum at the transverse center line of the strip to a minimum near said support end portions; said spring strip being made of flexible plastic material which deflects under a normal load so that the upper surface becomes substantially planar.

2. A spring strip according to claim 1, wherein the spring strip has an upper load support surface having a plurality of openings for permitting transpirability and lightening of the structure, the openings being formed by the junctions and bars.

3. A spring strip according to claim 1, wherein the plastic material is polypropylene.

4. A spring strip according to claim 1, wherein the material used is polyethylene.

5. A spring strip according to claim 1, wherein the width of the edges of the beam portions diminishes linearly from the transverse center line to the outer ends of the beam portions.

* * * * *